US007748876B2

(12) United States Patent
Zhang et al.

(10) Patent No.: US 7,748,876 B2
(45) Date of Patent: Jul. 6, 2010

(54) LED LAMP WITH A HEAT SINK ASSEMBLY

(75) Inventors: Wen-Xiang Zhang, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 58 days.

(21) Appl. No.: 11/943,505

(22) Filed: Nov. 20, 2007

(65) Prior Publication Data

US 2009/0040759 A1 Feb. 12, 2009

(30) Foreign Application Priority Data

Aug. 10, 2007 (CN) ..... 2007 1 0075660

(51) Int. Cl.
*F21V 29/00* (2006.01)
*F21V 21/00* (2006.01)

(52) U.S. Cl. ..... 362/373; 362/294; 362/249; 362/800; 165/104.33

(58) Field of Classification Search ..... 362/800, 362/373, 294, 249; 165/104.21, 104.33
See application file for complete search history.

(56) References Cited

U.S. PATENT DOCUMENTS 4,327,801 A * 5/1982 Koizumi et al. ..... 165/104.21
6,517,221 B1 * 2/2003 Xie ..... 362/373
6,892,800 B2 * 5/2005 Mok ..... 165/104.33
7,147,043 B2 * 12/2006 Lee et al. ..... 165/104.21
7,163,050 B2 * 1/2007 Wang et al. ..... 165/104.33
7,338,186 B1 * 3/2008 Wu et al. ..... 362/294
7,344,296 B2 * 3/2008 Matsui et al. ..... 362/652
7,494,248 B2 * 2/2009 Li ..... 362/294
2004/0213016 A1 * 10/2004 Rice ..... 362/547
2006/0001384 A1 1/2006 Tain et al.
2007/0230184 A1 * 10/2007 Shuy ..... 362/294
2008/0137337 A1 * 6/2008 Cheng et al. ..... 362/249
2009/0016072 A1 * 1/2009 Lee et al. ..... 362/373
2009/0016232 A1 * 1/2009 Kwon et al. ..... 370/252
2009/0046464 A1 * 2/2009 Liu et al. ..... 362/294

FOREIGN PATENT DOCUMENTS

CN 1656622 A 8/2005

* cited by examiner

*Primary Examiner*—Anabel M Ton
(74) *Attorney, Agent, or Firm*—Jeffrey T. Knapp

(57) ABSTRACT

An LED lamp includes a hollow first heat sink (10), a plurality of LED modules (40) respectively mounted on outer sidewalls (120) of the first heat sink, a second heat sink (20) being enclosed by the first heat sink, and a plurality of heat pipes (30) connecting the second heat sink to the first heat sink. The second heat sink includes an annular base (22) and a plurality of fins (24, 240) extending outwardly and radially from an outer sidewall of the base. The heat pipes couple the base of the second heat sink with the first heat sink, so that heat generated by the LED modules can be transferred from the first heat sink to the second heat sink via the heat pipes, thereby enhancing a heat dissipating efficiency of the LED lamp.

19 Claims, 4 Drawing Sheets

LED LAMP WITH A HEAT SINK ASSEMBLY

BACKGROUND OF THE INVENTION

1. Field of the Invention

The present invention relates to a light emitting diode (LED) lamp, and more particularly to an LED lamp incorporating heat pipes for improving heat dissipation of the LED lamp.

2. Description of Related Art

As an energy-efficient light, an LED lamp has a trend of substituting for the fluorescent lamp for indoor lighting purpose; in order to increase the overall lighting brightness, a plurality of LEDs are often incorporated into a signal lamp, in which how to efficiently dissipate heat generated by the LEDs becomes a challenge.

Conventionally, an LED lamp comprises a cylindrical enclosure functioning as a heat sink and a plurality of LEDs mounted on an outer wall of the enclosure. The LEDs are arranged in a plurality of lines along a height direction of the enclosure and around the enclosure. The enclosure defines a central through hole oriented along the height direction thereof. When the LEDs are activated to lighten, heat generated by the LEDs is dispersed to ambient air via the enclosure by natural air convection.

However, in order to achieve a compact design and facilitate a convenient transportation and handling of the LED lamp, the LED lamp is made having a small size, whereby the enclosure also has a small size, which leads to a limited heat dissipating area of the enclosure. The limited heat dissipating area makes the enclosure have a lower heat dissipating capability and may cause the LEDs to overheat, whereby the LEDs will operate unstably or even fail.

What is needed, therefore, is an LED lamp which can overcome the above-mentioned disadvantages.

SUMMARY OF THE INVENTION

An LED lamp includes a hollow first heat sink, a plurality of LED modules respectively mounted on outer sidewalls of the first heat sink, a second heat sink being enclosed by the first heat sink, and a plurality of heat pipes connecting the second heat sink to the first heat sink. The second heat sink includes an annular base and a plurality of fins extending outwardly and radially from an outer sidewall of the base. The heat pipes couple an inner face of the base of the second heat sink with an inner face of the first heat sink, so that heat generated by the LED modules can be transferred from the first heat sink to the second heat sink via the heat pipes, thereby enhancing a heat dissipating efficiency of the LED lamp.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
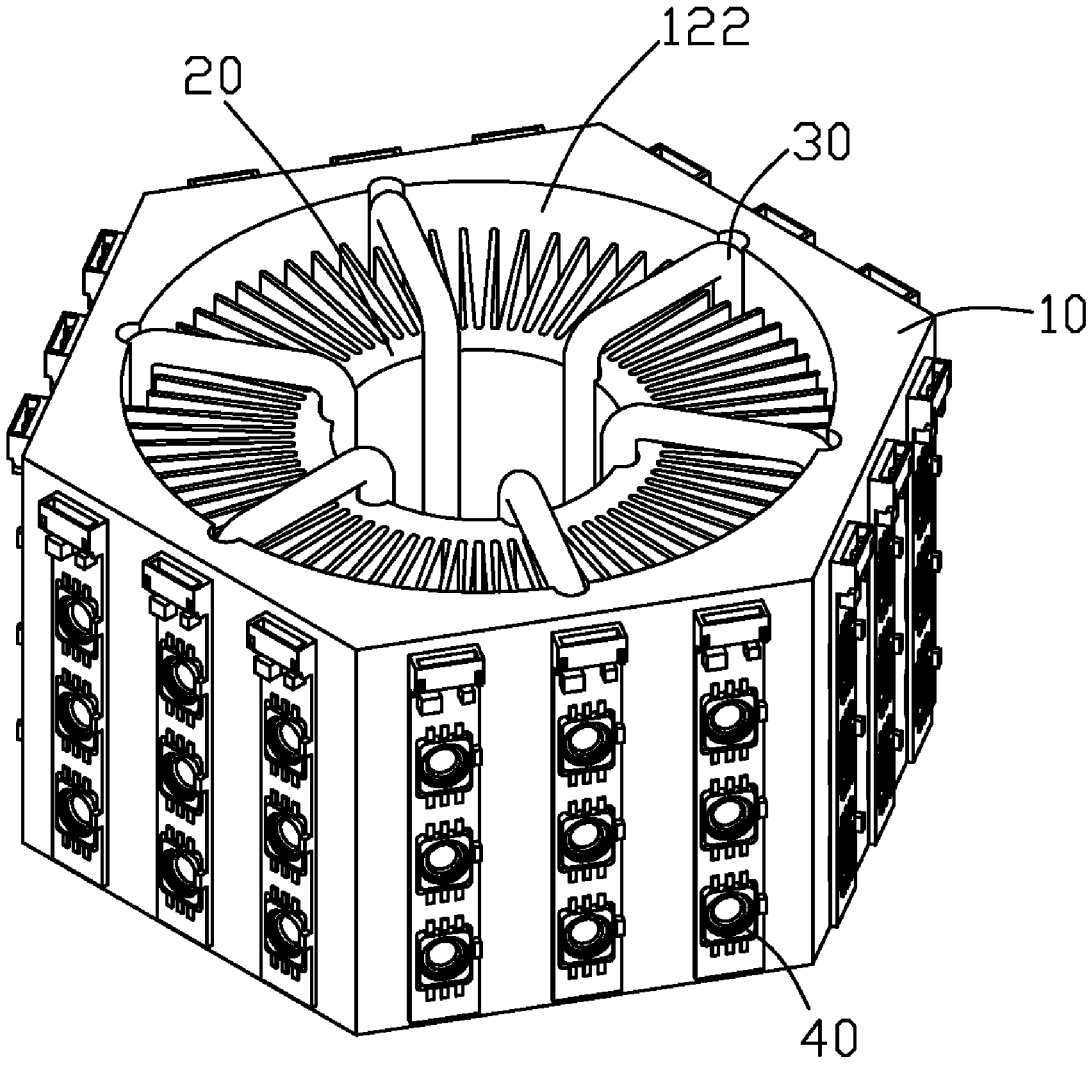
FIG. 1 is an assembled, isometric view of an LED lamp with a heat sink assembly in accordance with a preferred embodiment of the present invention.

Referring to FIG. 1, an LED lamp of a preferred embodiment of the present invention comprises a first heat sink 10, a second heat sink 20 being enclosed by the first heat sink 10, a plurality of heat pipes 30 connecting the first heat sink 10 to the second heat sink 20, and a plurality of LED modules 40 mounted on a periphery of the first heat sink 10.

Figure 2:
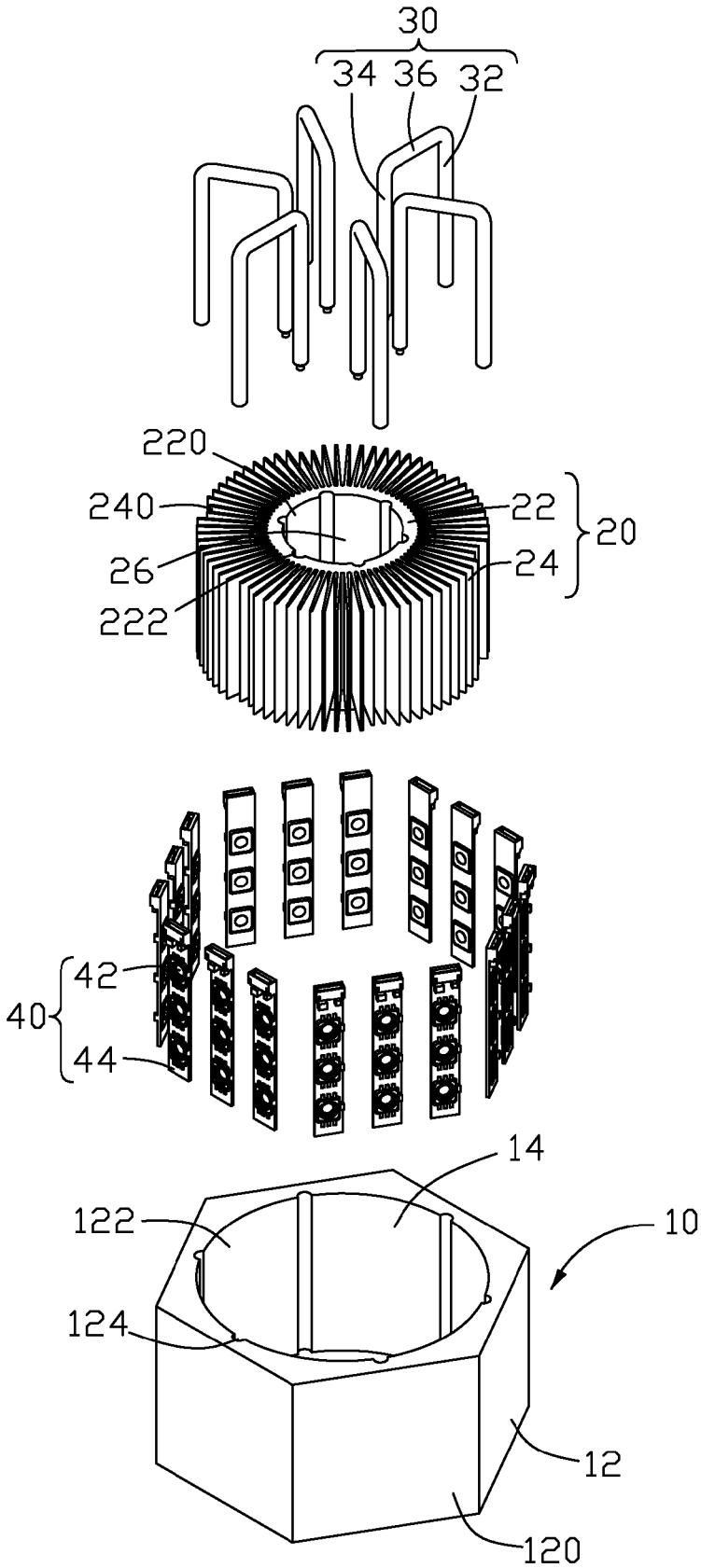
FIG. 2 is an exploded view of FIG. 1.

As shown in FIG. 2, the first heat sink 10 and the second heat sink 20 are made of metal such as aluminum, copper or an alloy thereof. The first heat sink 10 comprises a hollow hexagonal prism 12, which has six rectangular, flat and identical outer sidewalls 120. A circular through hole 14 is defined from a bottom to a top along an axis of the hexagonal prism 12 and located in a centre of the first heat sink 10, thereby defining a cylindrical inner face 122 of the hexagonal prism 12. Six straight and parallel grooves 124 each having a semicircular cross section are evenly defined at the inner face 122 along the axis of the hexagonal prism 12 and around the through hole 14 of the first heat sink 10. Each of the grooves 124 is located at a position adjacent to a middle of a corresponding outer sidewall 120 of the hexagonal prism 12 and communicates with the through hole 14 of the first heat sink 10.

The heat pipes 30 are for interconnecting the hexagonal prism 12 of the first heat sink 10 and the second heat sink 20. Each of the heat pipes 30 has a U-shaped configuration with two parallel sections respectively functioning as an evaporating section 32 and a condensing section 34, and a connecting section interconnecting the two parallel sections. The connecting section is employed as an adiabatic section 36. The heat pipes 30 are evenly fixed to the first heat sink 10 by soldering, wherein each of the evaporating sections 32 of the heat pipes 30 is accommodated in the groove 124 of the hexagonal prism 12, each of the adiabatic sections 36 of the heat pipes 30 is located adjacent to a top face of the hexagonal prism 12 (illustrated in FIG. 1), and each of the condensing sections 34 of the heat pipes 30 is spaced a distance from the inner face 122 of the hexagonal prism 12, whereby the condensing sections 34 of the heat pipes 30 are concentrated in a central area of the through hole 14 of the first heat sink 10.

Figure 3:
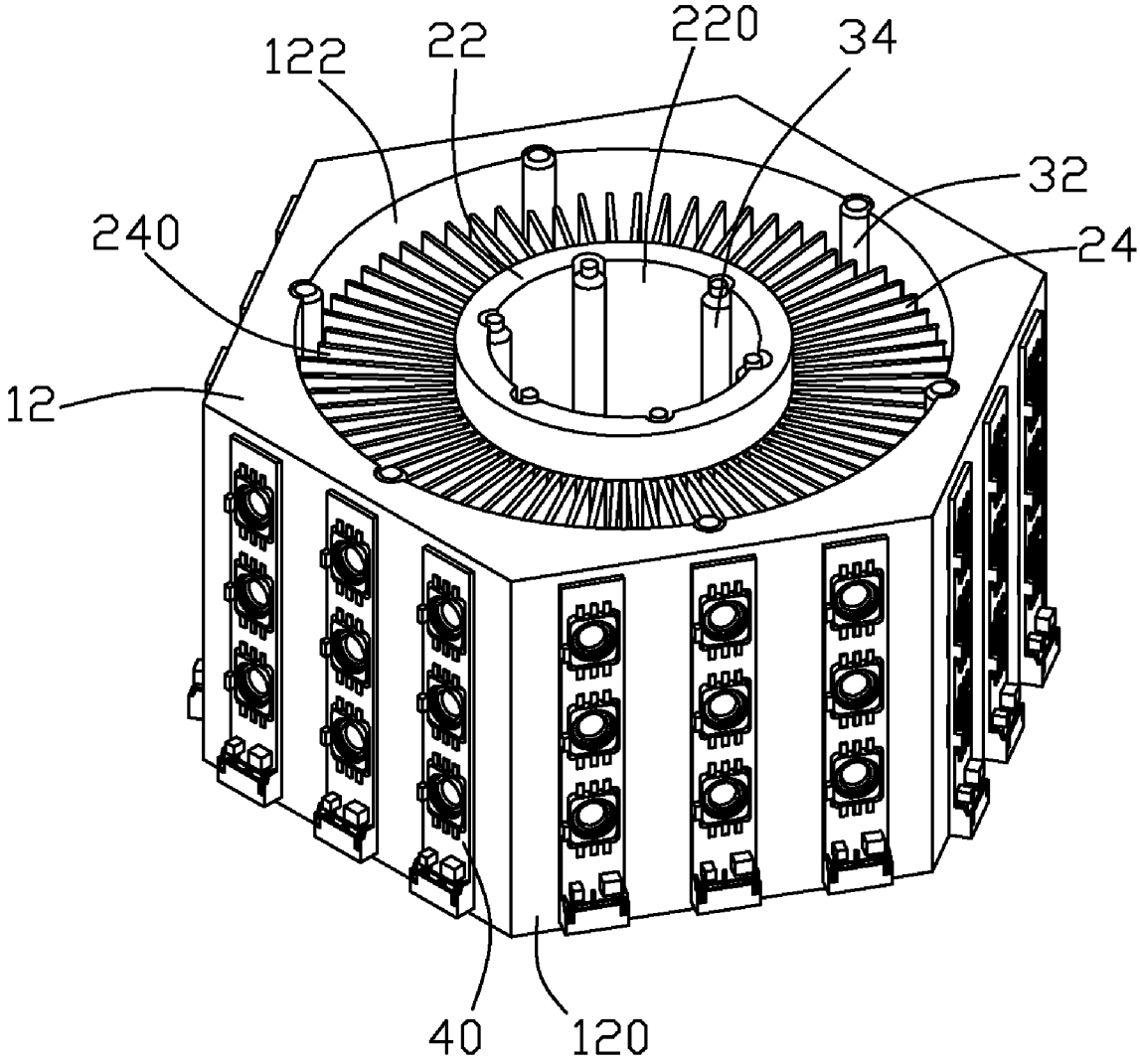
FIG. 3 is an inverted view of FIG. 1.

The second heat sink 20 is received in the through hole 14 of the first heat sink 10 in a manner that the condensing sections 34 of the heat pipes 30 are attached to the second heat sink 20. The second heat sink 20 increases heat dissipating area of the LED lamp. The second heat sink 20 comprises an annular base 22 that is coaxial with the hexagonal prism 12, and a plurality of fins 24 extending outwardly and radially from an outer sidewall (not labeled) of the base 22. The base 22 defines a circular opening 26 in a central area of the second heat sink 20, whereby the base 22 has a cylindrical inner face 220. Six slots 222 are defined at the inner face 220 of the base 22, corresponding to the grooves 124 of the first heat sink 12 with each of the six slots 222 extending from a bottom to a top along an axis of the base 22. The six slots 222 are distributed evenly with respective to the opening 26 of the second heat sink 20. The fins 24 are evenly spaced from each other to define a plurality of gaps (not labeled) therebetween for allowing an airflow to flow through the second heat sink 20. As can be seen from FIGS. 1 and 3, each of the fins 24 has a bottom portion located above a bottom face of the base 22, and a top portion being coplanar with a top face of the base 22. Two adjacent fins 240 located corresponding to each of the slots 222 of the base 22 each have a radial length less than that of the fins 24 for preventing the evaporating sections 32 of the heat pipes 30 from interfering with the fins 240 of the second heat sink 20 when mounting the second heat sink 20 to the first heat sink 10. Each of the fins 24, 240 of the second heat sink 20 is spaced a distance from the inner face 122 of the first heat sink 10. A height of the base 22 of the second heat sink 20 is less than that of the first heat sink 10, so that the second heat sink 20 can be substantially received in the through hole 14 of the first heat sink 10 (shown in FIG. 1). Each of the condensing sections 34 of the heat pipes 30 is retained in the slot 222 of the second heat sink 20, each of the evaporating sections 32 of the heat pipes 30 confronts corresponding two adjacent fins 240, and each of the adiabatic sections 36 of the heat pipes 30 is located above the corresponding two adjacent fins 240 of the second heat sink 20; therefore, the heat pipes 30 span across the fins 240 of the second heat sink 20 and interconnect the second heat sink 20 and the first heat sink 10 together.

The LED modules 40 are mounted on the outer sidewalls 120 of the hexagonal prism 12 of the first heat sink 10 respectively. Each of the LED modules 40 comprises a rectangular printed circuit board 44 and a plurality of LEDs 42 arranged on a side along an elongated direction of the printed circuit board 44. Three LED modules 40 are secured to each of the outer sidewalls 120 of the hexagonal prism 12 along the axis of the first heat sink 10 with an opposite side of the printed circuit boards 44 of the three LED modules 40 contacting each of the outer sidewalls 120 of the hexagonal prism 12. A middle LED module 40 of the three LED modules 40 is located near a corresponding groove 124 of the hexagonal prism 12 for ensuring that heat generated by the LEDs 42 can be conducted to the outer sidewalls 120 of the hexagonal prism 12 evenly.

Figure 4:
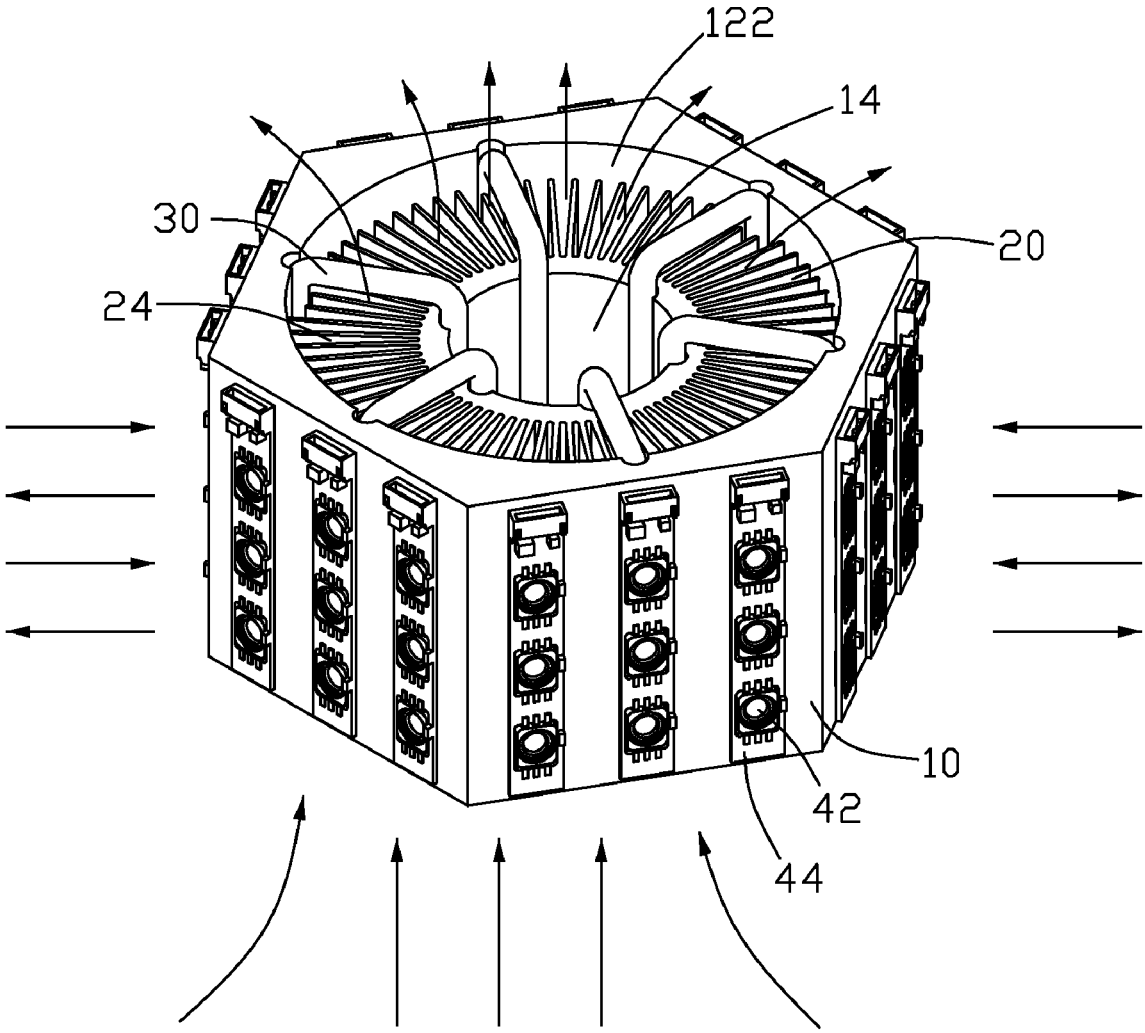
FIG. 4 is a view similar to FIG. 1 with arrows indicating flowing directions of heated air from the LED lamp and cooling air to the LED lamp.

As shown in FIG. 4, in use, when the LEDs 42 are activated to lighten, the heat generated from the LEDs 42 is conducted to the first heat sink 10 via the printed circuit board 44. Since the heat pipes 30 connect the first heat sink 10 and the second heat sink 20, the heat can be not only dissipated by the first heat sink 10, but also dissipated by the second heat sink 20. A part of the heat is dispersed to the ambient cool air via the sidewalls 120 of the first heat sink 10. Another part of the heat is conveyed to the inner face 122 of the first heat sink 10. Remaining part of the heat is transmitted to the second heat sink 20 via the heat pipes 30. The heat concentrated on the second heat sink 20 and the inner face 122 of the first heat sink 10 is dispersed to the cool air which flows upwardly through the through hole 14 of the first heat sink 10. The cool air absorbs the heat and is heated. As hot air has a less density than that of the cool air, the hot air flows upwardly away from the first and second heat sink 10, 20 through an upper portion of the through hole 14 of the first heat sink 10, and the cool air flows into the first heat sink 10 through a lower portion of the through hole 14 of the first heat sink 10 to substitute the hot air in a natural convection manner. Then the cool air absorbs the heat from the inner face 122 of the first heat sink 10 and the second heat sink 20 to be converted into hot air, thus circulating the air convection continuously. From the above description, the LED lamp has an improved heat dissipating capability for preventing the LEDs 42 from overheating.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a hollow prism-shaped first heat sink with a through hole defined from a bottom to a top thereof and a plurality of outer sidewalls;

a plurality of LED modules being mounted on the outer sidewalls and around the through hole of the first heat sink respectively, each of the LED modules comprising a printed circuit board and a plurality of LEDs mounted thereon;

a second heat sink being received in the through hole of the first heat sink and being enclosed by the first heat sink; and a plurality of heat pipes connecting the first heat sink to the second heat sink;

wherein when the LEDs are activated, heat generated by the LED modules is conducted to the first heat sink firstly, and then is transferred to the second heat sink by the heat pipes; and wherein the first heat sink has an inner face enclosing the through hole thereof, and a plurality of grooves is defined at the inner face of the first heat sink and communicates with the through hole of the first heat sink.

2. The LED lamp as claimed in claim 1, wherein the outer sidewalls of the first heat sink have a number of six.

3. The LED lamp as claimed in claim 1, wherein the grooves extend along an axis of the first heat sink and parallel to each other, each of the grooves being located at a position near a middle of a corresponding outer sidewall of the first heat sink.

4. The LED lamp as claimed in claim 1, wherein each of the heat pipes comprises an evaporating section, a condensing section parallel to the evaporating section, and an adiabatic section interconnecting the evaporating section and the condensing section, each of the evaporating sections of the heat pipes being received in a corresponding groove of the first heat sink.

5. The LED lamp as claimed in claim 4, wherein the second heat sink comprises an annular base, and a plurality of fins extending outwardly from an outer sidewall of the base, the base of the second heat sink being positioned in a central area of the through hole of the first heat sink.

6. The LED lamp as claimed in claim 5, wherein each of the fins of the second heat sink has a top portion coplanar with a top face of the base and a bottom portion above a bottom face of the base of the second heat sink, a height of the second heat sink being less than that of the first heat sink and the through hole of the first heat sink substantially receiving the second heat sink therein.

7. The LED lamp as claimed in claim 5, wherein the base of the second heat sink has a plurality of slots defined at an inner face thereof, corresponding to the grooves of the first heat sink for accommodating the condensing sections of the heat pipes therein.

8. The LED lamp as claimed in claim 7, wherein each of the adiabatic sections of the heat pipes is located above the second heat sink for allowing each of the heat pipes to span across the fins of the second heat sink.

9. The LED lamp as claimed in claim 8, wherein two adjacent fins located corresponding to each of the slots of the second heat sink each have a radial length less than that of other fins of the second heat sink, each of the adiabatic sections of the heat pipes being located above said two adjacent fins of the second heat sink.

10. The LED lamp as claimed in claim 5, wherein each of the fins of the second heat sink is spaced a distance from the inner face of the first heat sink, whereby the heat generated by the LEDs is transferred to the first heat sink, the heat pipes, and the second heat sink in sequence.

11. A heat sink assembly for dissipating heat from LED modules, comprising:

a hollow housing and a plurality of fins received in the housing, the housing having a plurality of outer sidewalls adapted for mounting the LED modules thereon, and an inner face enclosing a through hole, the fins connecting with each other at ends thereof to form an annular base and a circular opening being defined through the annular base; and a plurality of heat pipes each having a portion attached to the inner face of the housing, and another portion fixed to the base of the heat sink, thus connecting the housing to the base.

12. The heat sink assembly as claimed in claim 11, wherein a plurality of grooves is defined at the inner face of the housing, and a plurality of slots is defined at an inner face of the base corresponding to the grooves of the housing.

13. The heat sink assembly as claimed in claim 12, wherein each of the heat pipes has a U-shaped configuration and comprises a condensing section, an evaporating section parallel to the condensing section, and an adiabatic section connecting the condensing section with the evaporating section.

14. The heat sink assembly as claimed in claim 13, wherein each of the evaporating sections of the heat pipes is received in each of the grooves of the housing, each of the condensing sections of the heat pipes is accommodated in each of the slots of the base, and each of the adiabatic sections of the heat pipes is located above the fins.

15. The heat sink assembly as claimed in claim 11, wherein the base is coaxial with the housing with a height of the base being less than that of the housing in a manner that the base is received in the through hole of the housing substantially.

16. An LED lamp comprising:

a first heat sink defining a central through hole and an outer wall;

at least an LED module mounted on the outer wall of the first heat sink;

a second heat sink received in the central through hole of the first heat sink, the second heat sink defining a central through hole; and at least a heat pipe having an evaporating section extending into the central through hole of the first heat sink and attached to the first heat sink and a condensing section extending into the central through of the second heat sink and attached to the second heat sink.

17. The LED lamp as claimed in claim 16, wherein the second heat sink has a plurality of radially and outwardly extending fins.

18. The LED lamp as claimed in claim 17, wherein the at least a heat pipe has a U-shaped configuration.

19. The LED lamp as claimed in claim 18, wherein the outer wall of the first heat sink has a polygonal configuration.

* * * * *